US006530559B1

(12) United States Patent
Pell

(10) Patent No.: US 6,530,559 B1
(45) Date of Patent: Mar. 11, 2003

(54) PRY APPARATUS

(76) Inventor: Scott Pell, 5222 Kingsmill, Friendswood, TX (US) 77546

( * ) Notice: Subject to any disclaimer, the term of this patent is extended or adjusted under 35 U.S.C. 154(b) by 8 days.

(21) Appl. No.: 09/860,902

(22) Filed: May 18, 2001

(51) Int. Cl.[7] ..... B66F 3/00
(52) U.S. Cl. ..... 254/93 R; 254/124
(58) Field of Search ..... 254/25, 28, 22, 254/15, 17, 131, 93 R; 29/239, 267

(56) References Cited

U.S. PATENT DOCUMENTS 722,975 A * 3/1903 Haley ..... 254/28
3,819,153 A * 6/1974 Hurst et al. ..... 254/93 R

* cited by examiner

*Primary Examiner*—Robert C. Watson
(74) *Attorney, Agent, or Firm*—Kenneth H. Johnson

(57) ABSTRACT

A pneumatically actuated lever arrangement provides the force to open a pry which operates in cooperation with a fixed wedge to efficiently separate nailed boards to make recovery and reuse of the boards economically feasible.

8 Claims, 4 Drawing Sheets

PRY APPARATUS

BACKGROUND OF THE INVENTION

1. Field of the Invention

The present invention relates a device for use in demolition or deconstruction. More specifically it is a device for use to pry conjoined objects apart.

2. Related Information

In demolition, the high cost of recovering and recycling materials usually results in the deposition of potentially valuable material in to waste dumps. In new construction utility grade lumber is often used and disposed of in substantially new condition, because the cost of tearing apart this grade of lumber is higher than the cost of new lumber. Heretofore lumber that has been nailed together is separated by manual prying.

The present invention has as an advantage that the labor is greatly reduced in prying apart lumber that is nailed.

SUMMARY OF THE INVENTION

Briefly the present invention is a prying apparatus comprising a frame having a wedge portion at is distal end, a blade pivotally mounted toward the distal end in cooperative alignment with the wedge portion. An extension is rigidly attached to the blade and extends away from the distal end, and an arm is pivotally attached at one end to a terminal end of the extension and at the other end to a lever. The lever is pivotally mounded to the frame at a point an unequal distance between said ends of said lever to form a short section and a long section. A power source is preferably mounted on the frame to operate the lever.

DETAILED DESCRIPTION

Figure 1:
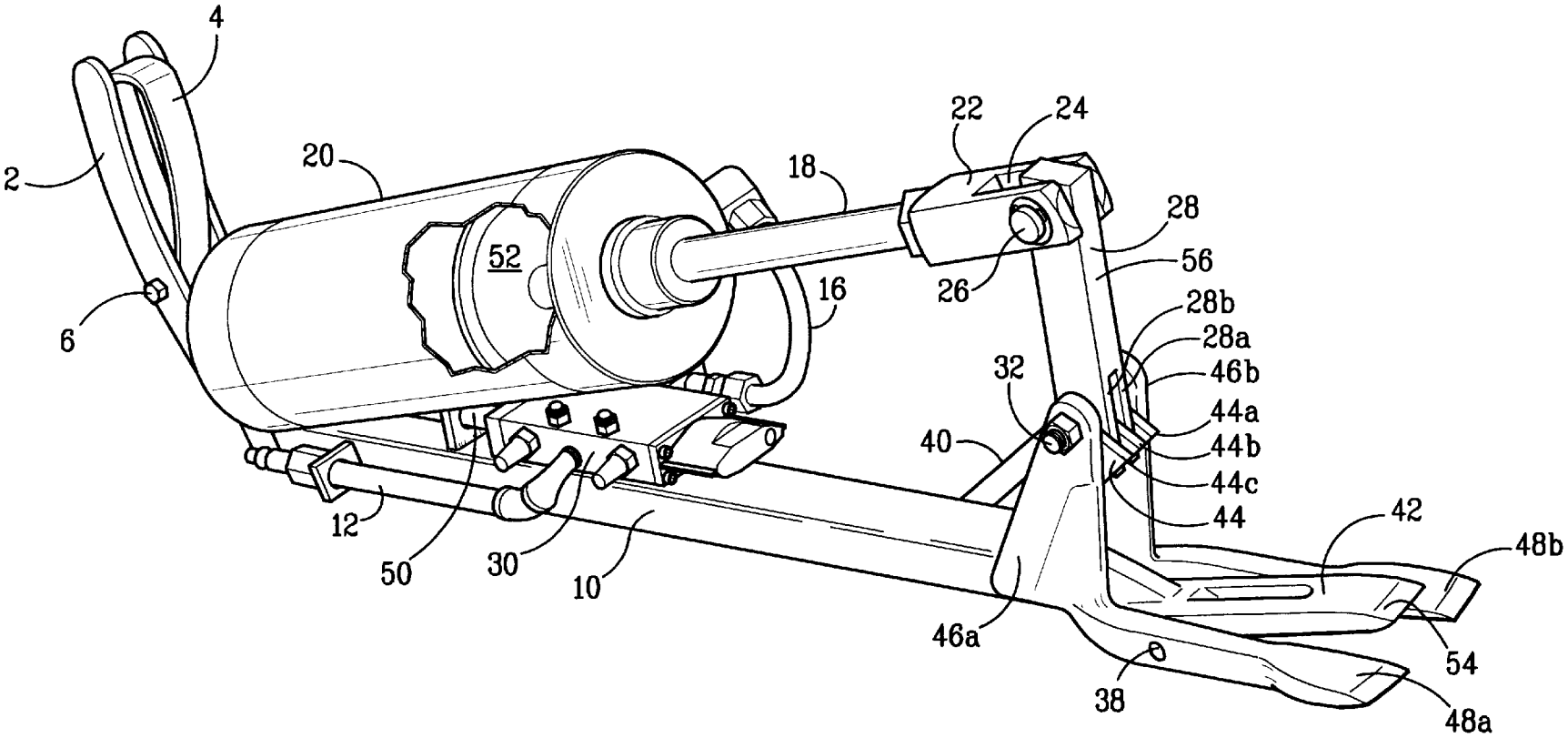
FIG. 1 is an isometric view of a preferred embodiment of the present apparatus.

Referring now to FIG. 1 the apparatus shown is a prospective view. The frame 10 is generally linear at a proximal end. A pneumatic cylinder is pivotally attached to handle 40 by bolt 8. A cutaway section shows the piston 52 to which rod 18 is attached. The pneumatically operated cylinder provides the actuating force for the apparatus in the preferred embodiment. The piston is actuated by directing air through either lines 14 or 16. Air directed through line 14 moves the rod 18 to extend outward and actuate the linkage (described below) to the pry blade 42 (hereinafter called "the pry") open away from the fixed wedges 48*a* and 48*b*. Air directed through line 16 causes the pry 42 to close. The air is directed to the selected line by-manual operation of switch control 4 which is pivotally mounted on pin 6 in handle 2 of the frame and moves rod 50 in to direct from line 12 air to line 14 and on release the rod 40 is biased (not shown) within switch 30 to direct the air to line 16 and close the pry. Thus, squeezing the switch control 4 causes the pry to open and release causes it to close.

Figure 2:
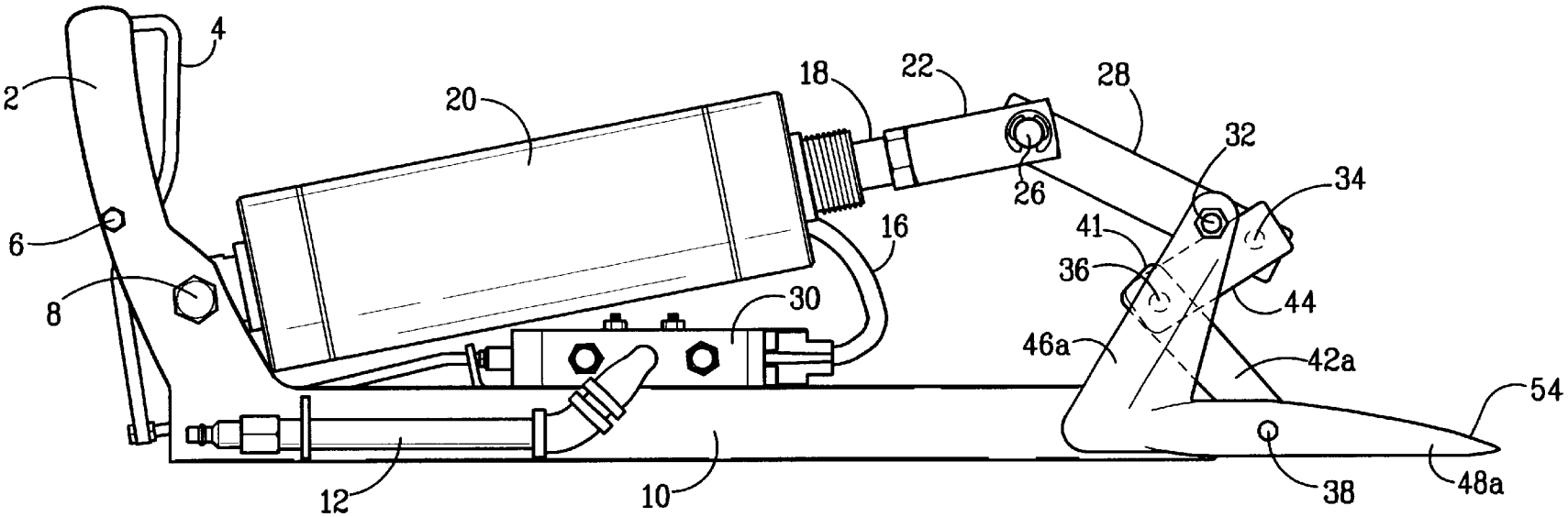
FIG. 2 is an elevational side view of the apparatus of FIG. 1 in the actuated position.
Figure 3:
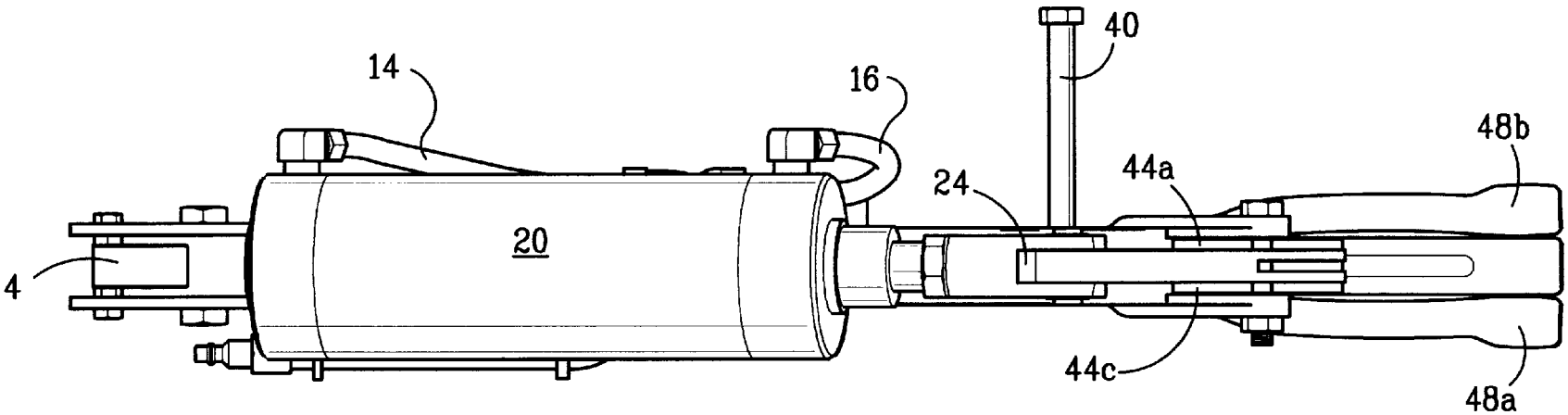
FIG. 3 is a top in plan view if the apparatus of FIG. 1.
Figure 4:
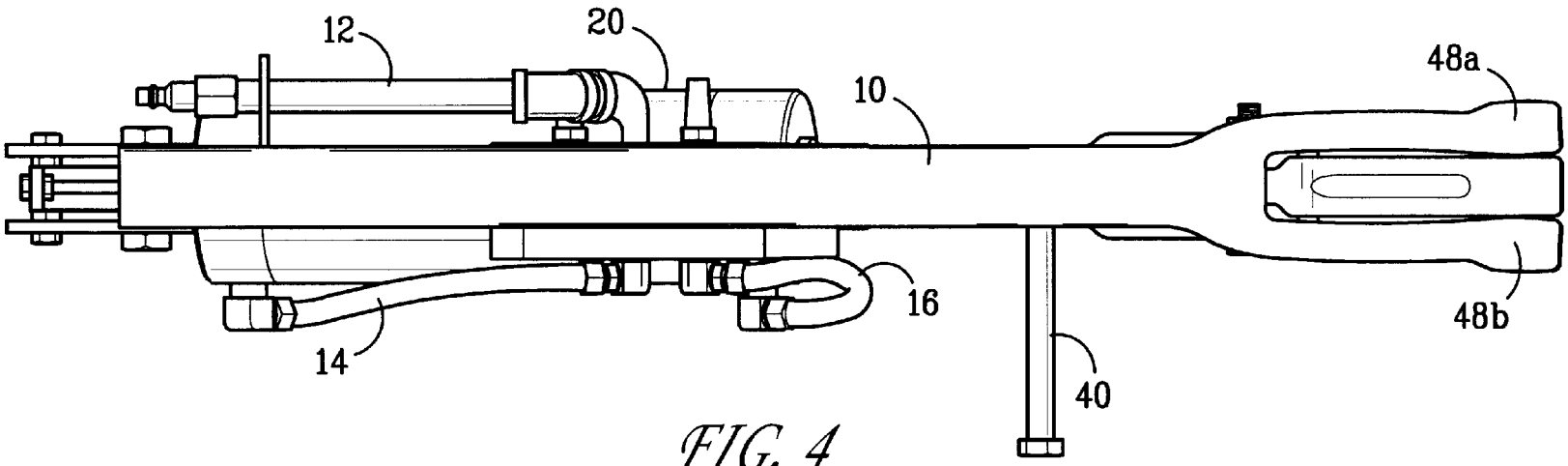
FIG. 4 is a bottom in plan view of the apparatus of FIG. 1

Referring to FIG. 2 the apparatus is shown with the pry 42 closed. In the pry it is cooperatively aligned with the fixed wedges 48*a* and 48*b* and rests between them. As shown in FIG. 2 in this configuration these three components have a single profile of beveled surfaces 54 for insertion between conjoined material such as boards nailed together.

The rod 18 is affixed to fitting 22 which pivotally attached to slot 24 to lever 28 by pin 26. Lever 28 is pivotally mounted to the member 46*a* and 46*b* which extends from the frame and form a bracket where the lever 28 is mounted on pin 32. The pin 32 is the fulcrum of the lever. The long end 56 of the lever 28 is attached to the pry.

Figure 6:
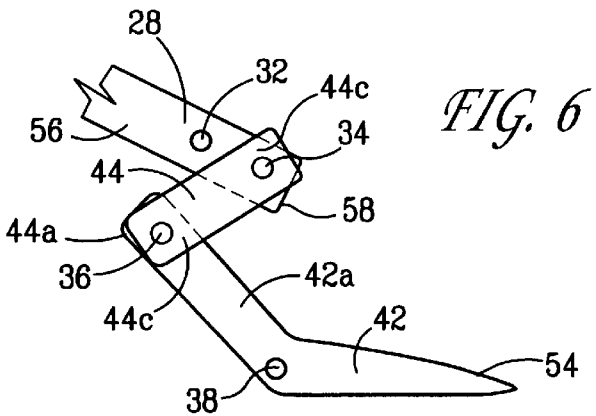
FIG. 6 is a detail of the lever linkage of the present apparatus.
Figure 5:
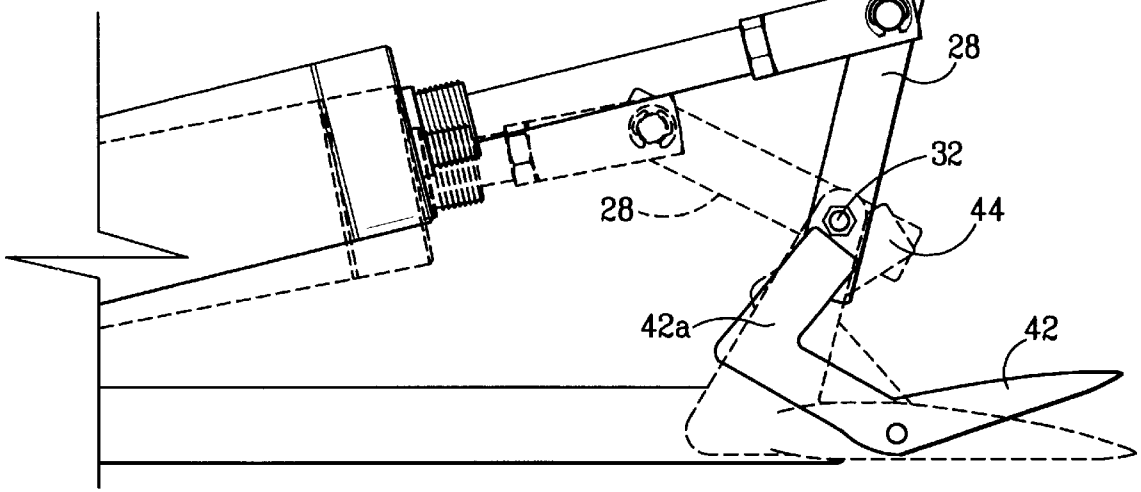
FIG. 5 is partial side elevational view of the apparatus of FIG. 1 showing the at rest and actuated positions.

Referring to FIG. 6, arm 44 is shown as pivotally attached by pin 36 to the extension 42*a* of pry 42. The short end 58 of the lever 28 is attached to arm 44 by pin 34 which links the level to pry. The pry 42 is pivotally mounted between the wedges 48*a* and 48*b* on pin 38 as shown in FIG. 1.

In the preferred embodiment the various components of the linkage system is shown as joined by fingers on the cooperating components. Fingers 44*a–c* of arm 44 interlaced with fingers 41 (only one of two fingers is visible) of extension 42*a* on the one end and with finger 28*a–b* of lever 28 on the other end. Also arm 40 is provided for controlling and placing the apparatus which is conveniently suspended on a balanced line (now shown) when in use.

The invention claimed is:

1. An apparatus comprising:

a frame having a wedge portion at a distal end thereof, a blade pivotally mounted toward the distal end of said frame in cooperative alignment with said wedge portion, an extension rigidly attached to said blade and extending away from said distal end, an arm having two ends and pivotally attached at a first end to a terminal end of said extension and a lever having two ends, said lever being pivotally mounded to said frame at a point an unequal distance between said ends of said lever to form a short section and a long section, said long section being longer than said short section, the end of said short section being pivotally attached to a second end of said arm.

2. The apparatus according to claim 1 wherein said frame is generally linear from said distal end to a proximal end.

3. The apparatus according to claim 1 wherein a power source is mounted adjacent to said proximal end, said power source being pivotally connected to the long section of said lever.

4. The apparatus according to claim 3 wherein said power source provides rectilinear force to rotate said lever.

5. The apparatus according to claim 4 wherein said power source comprises a fluid operated piston within a cylinder, pivotally mounted to said frame adjacent to said proximal end.

6. The apparatus according to claim 5 wherein said piston has a rod affixed thereto, said rod being pivotally attached to said long section of said lever.

7. The apparatus according to claim 1 wherein said piston is moveable by fluid directed into said cylinder.

8. An apparatus comprising:

a pneumatic cylinder pivotally mounted at a proximal end of a frame, said pneumatic cylinder having a first air inlet at first end of said cylinder and a second air inlet at a second end of said cylinder, a piston slidably mounted in said cylinder, a rod attached to said piston and a switch to direct air alternatively to said first air inlet or said second air inlet;

a lever having two ends, said lever being pivotally mounded to said frame at a point an unequal distance between said ends of said lever to form a short section and a long section, said long section being longer than said short section, the end of said long section being pivotally attached to said rod;

a wedge portion at a distal end of said frame, a blade pivotally mounted toward the distal end of said frame in cooperative alignment with said wedge portion, an extension rigidly attached to said blade and extending away from said distal end, an arm having two ends and pivotally attached at a first end to a terminal end of said extension and at a second end to the short section of said lever.

* * * * *